US012746429B2

(12) United States Patent
Tsuzuki

(10) Patent No.: US 12,746,429 B2
(45) Date of Patent: Sep. 29, 2026

(54) TRAINING DEVICE

(71) Applicant: Club Create Co., Ltd., Tokyo (JP)

(72) Inventor: Takeo Tsuzuki, Tokyo (JP)

(73) Assignee: Club Create Co., Ltd., Tokyo (JP)

( * ) Notice: Subject to any disclaimer, the term of this patent is extended or adjusted under 35 U.S.C. 154(b) by 63 days.

(21) Appl. No.: 18/350,937

(22) Filed: Jul. 12, 2023

(65) Prior Publication Data

US 2024/0139577 A1 May 2, 2024

(30) Foreign Application Priority Data

Jul. 13, 2022 (JP) ..... 2022-112794

(51) Int. Cl.
*A63B 21/00* (2006.01)

(52) U.S. Cl.
CPC ..... *A63B 21/4029* (2015.10); *A63B 2225/09* (2013.01)

(58) Field of Classification Search
CPC ..... A63B 21/4029
See application file for complete search history.

(56) References Cited

U.S. PATENT DOCUMENTS 4,911,435 A * 3/1990 Johns ..... A63B 23/03533 482/99
5,100,128 A * 3/1992 Mabry ..... A63B 21/0628 482/137
5,277,685 A * 1/1994 Gonzales ..... A63B 71/0009 482/134
7,717,824 B2 * 5/2010 Pinto ..... A63B 23/12 482/7
7,722,509 B2 * 5/2010 Eder ..... A63B 21/156 482/99
8,308,620 B2 * 11/2012 Lyszczarz ..... A63B 21/4029 482/142
9,248,329 B2 * 2/2016 Heideman ..... A63B 21/151
2021/0046354 A1 * 2/2021 Oaks ..... A47B 83/001

FOREIGN PATENT DOCUMENTS

JP 4205735 B2 * 1/2009

* cited by examiner

*Primary Examiner* — Joshua T Kennedy
(74) *Attorney, Agent, or Firm* — Bond, Schoeneck & King, PLLC; Cecily Capo

(57) ABSTRACT

To provide a training apparatus which is especially easy for both a healthy person and a wheelchair user to use. A training apparatus configured a seat, the training apparatus comprising;

a seat connecting unit configured to connect the seat and the training apparatus;

a sheet moving unit configured to move the sheet, a sheet fixing unit configured to fix the sheet at an optimum position, wherein the training apparatus fixes the seat at a seat fixing position suitable for a healthy user; and provides a training apparatus capable of moving the seat to a seat position suitable for a wheelchair user.

4 Claims, 6 Drawing Sheets

TRAINING DEVICE

BACKGROUND OF THE INVENTION

Field of Invention

The present invention relates to a training apparatus, and more particularly to a training apparatus which is easy to use for both healthy persons and wheelchair users.

Various types of training apparatus are used for performing muscle training and stretching exercises on muscles at specific positions of the body.

For example, the applicant provides society with a stretching machine "shoulder wing apparatus" for stretching the shoulders.

The shoulder-wing device 2 is a device that mainly moves the scapulae, the shoulder-joint, the spinal column, and muscles of the entire upper body, such as the trapezius muscle, the latissimus dorsi muscle, the rhomboideus muscle, the erector spinae muscle, and the deltoid muscle, which are connected to the scapulae, the shoulder-joint, and the spinal column. A shoulder wing device 2 is constituted so that a weight frame 6 is erected at one end of a body base 4, an arm supporting frame 8 is erected at the other end, a seating part base 10 is connected to the body base 4 at the side end part of the arm supporting frame 8 and a seat supporting frame 12 is erected at the end part. The weight frame 6 and the arm support frame 8 are also connected to each other by a lateral frame 14.

At the distal end of the arm support frame 8, a rotary shaft 16 extends in the horizontal direction, and two connecting plates 19 are rotatably provided around the rotary shaft 16. The arm 18 connected to the two connecting plates 19 extends from the bottom portion in a bifurcated manner, is covered with a pad 20 in the middle thereof, and is provided with a U-shaped handle 24 having a rotating shaft 22 at the end thereof in a direction perpendicular to the arm 18 to the arm 18.

A seat 42 is arranged at the tip of the seat support frame 12, and the seat support frame 12 is connected to the arm support frame 8 by a seat lateral frame 44.

In the shoulder wing device 2, the user sits on the seat 42 of the shoulder wing device 2 according to the invention and places his hand on the U-shaped handle 24 with both hands. At this time, the person to be measured holds the U-shaped handle 24 and performs a push-down stretching exercise. A healthy person can freely sit on the seat 42 and perform stretching exercise. Further, since the position of the seat 42 is supported by the seat support frame 12, the seat 42 is fixed at an optimum position, and the healthy person can perform the stretching exercise at the optimum position.

When an elderly person or a physically handicapped person using a wheelchair tries to use the shoulder wing apparatus 2, the wheelchair of the elderly person or the physically handicapped person interferes with the seat 42, the seat lateral frame 44, and the seating portion base 10, and the seat 42 must be physically removed. In addition, when it is removed, it is not easy to return it to the original state.

Therefore, Patent Document 1 discloses a state in which the exercise assisting device 1 and the chair 5 are made independent from each other, and as shown in FIG. 7 of Patent Document 1, an elderly person or a handicapped person can exercise while riding in a wheelchair. [Patent Document 1] Japanese Patent Application Laid-Open No. 198536/2019

SUMMARY OF INVENTION

The existing shoulder wing device 2 cannot be used while riding a wheelchair. If the seat 42, the seat lateral frame 44, and the seating portion base 10 are removed, it is not easy to mount the seat again.

Further, in the case of Patent Document 1, although there is no problem when a wheelchair is used, when a healthy person uses the seat, unlike the conventional fixed seat, there is a degree of freedom in the arrangement of the seat, and there are cases where the center line of the left and right arms and the center axis of the chair coincide with each other with respect to the training with respect to the training apparatus or a case where the seat cannot be arranged at an optimum position. In this case, appropriate training may not be performed. Further, in Patent Document 1, when a wheelchair user uses the chair, the chair is manually moved. Further, when the wheelchair user finishes using the chair and a healthy person continues to use the chair, the chair must be manually moved to the original position again, which is extremely troublesome. In addition, as described above, in order for a healthy person to use the apparatus, it is necessary to accurately return the apparatus to an optimum position.

Accordingly, it is an object of the present invention to provide a training apparatus which facilitates switching of the position of a chair so that both a healthy person and a wheelchair user can train at the center position or the optimum position of the left and right arms.

According to the present invention, there is provided a training apparatus means for connecting the seat and the training apparatus to each other, a seat moving means for moving the seat, and a seat fixing means for fixing the seat at an optimum position. The seat connecting unit is a horizontal rotating body for connecting the training apparatus body and the seat frame. The seat connecting unit is a vertical rotating body for connecting the training apparatus body and the seat frame. The rotating body includes a rotating shaft and a hinge. The seat connecting unit is connected to a rail provided on the training apparatus body by a horizontal moving body provided on the seat frame. The seat moving means is a leg part projected under the seat and a wheel provided at the tip of the leg part. As the sheet moving means, a locking body, a pedestal or the like can be adopted. The seat fixing means is a spring type pin for fixing the training apparatus body and the seat frame. As the sheet fixing means, an insertion pin or the like can be adopted. The sheet connecting means is a rotating body provided between a plurality of foldable sheets or between the sheet and the training apparatus.

By using the training apparatus according to the present invention, the training apparatus can be easily used by both a healthy person and a wheelchair user, the seat can be arranged at an optimum position even when the healthy person uses the training apparatus, and the wheelchair user can also use the training apparatus at an optimum position.

DETAILED DESCRIPTION OF THE INVENTION

Figure 1:
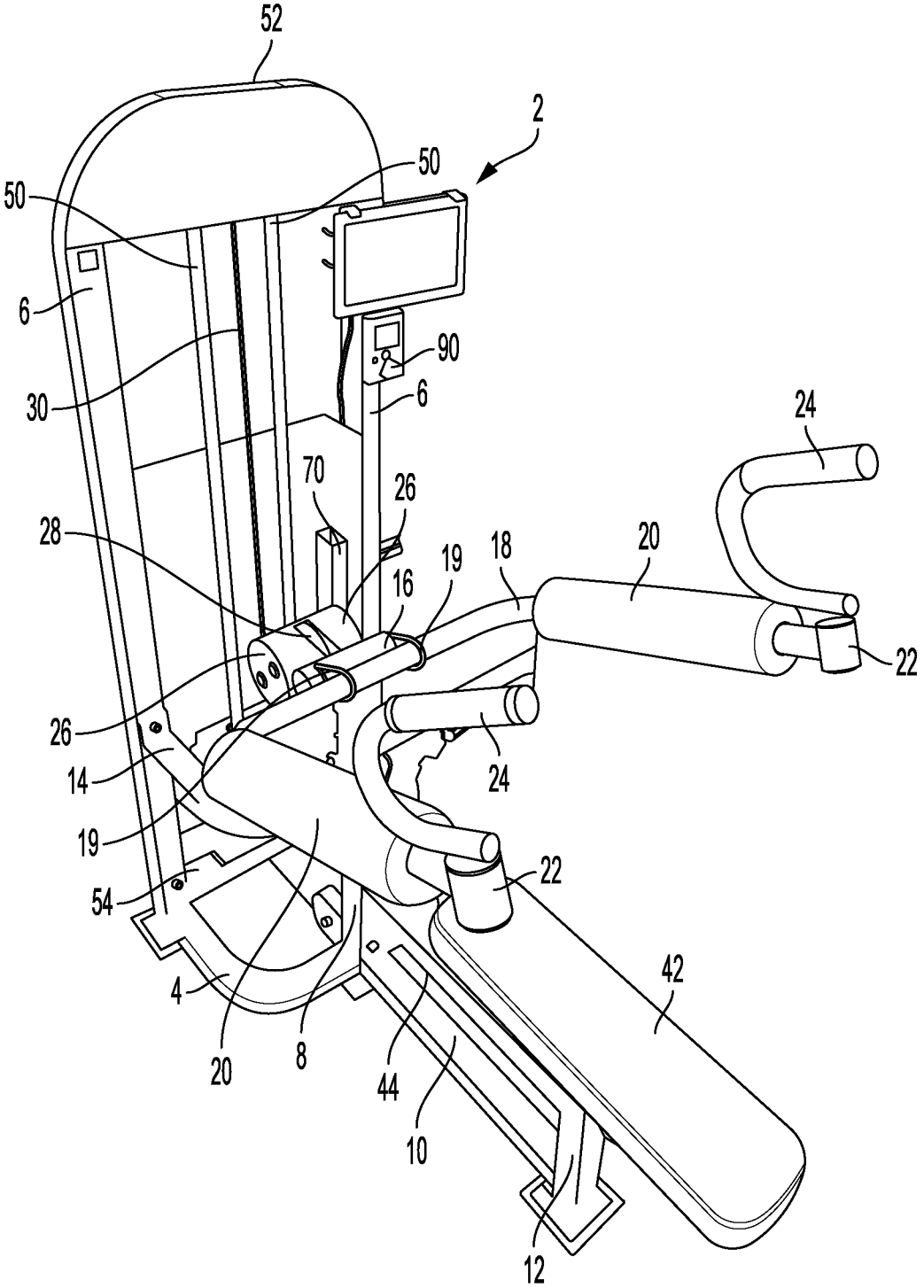
FIG. 1 PRIOR ART
FIG. 1 is a configuration diagram of a conventional shoulder wing device.

Next, embodiments of the present invention will be described in detail with reference to the drawings. In all the drawings described below, the same components are denoted by the same reference numerals, and description thereof will be omitted as appropriate.

Example 1

Figure 2:
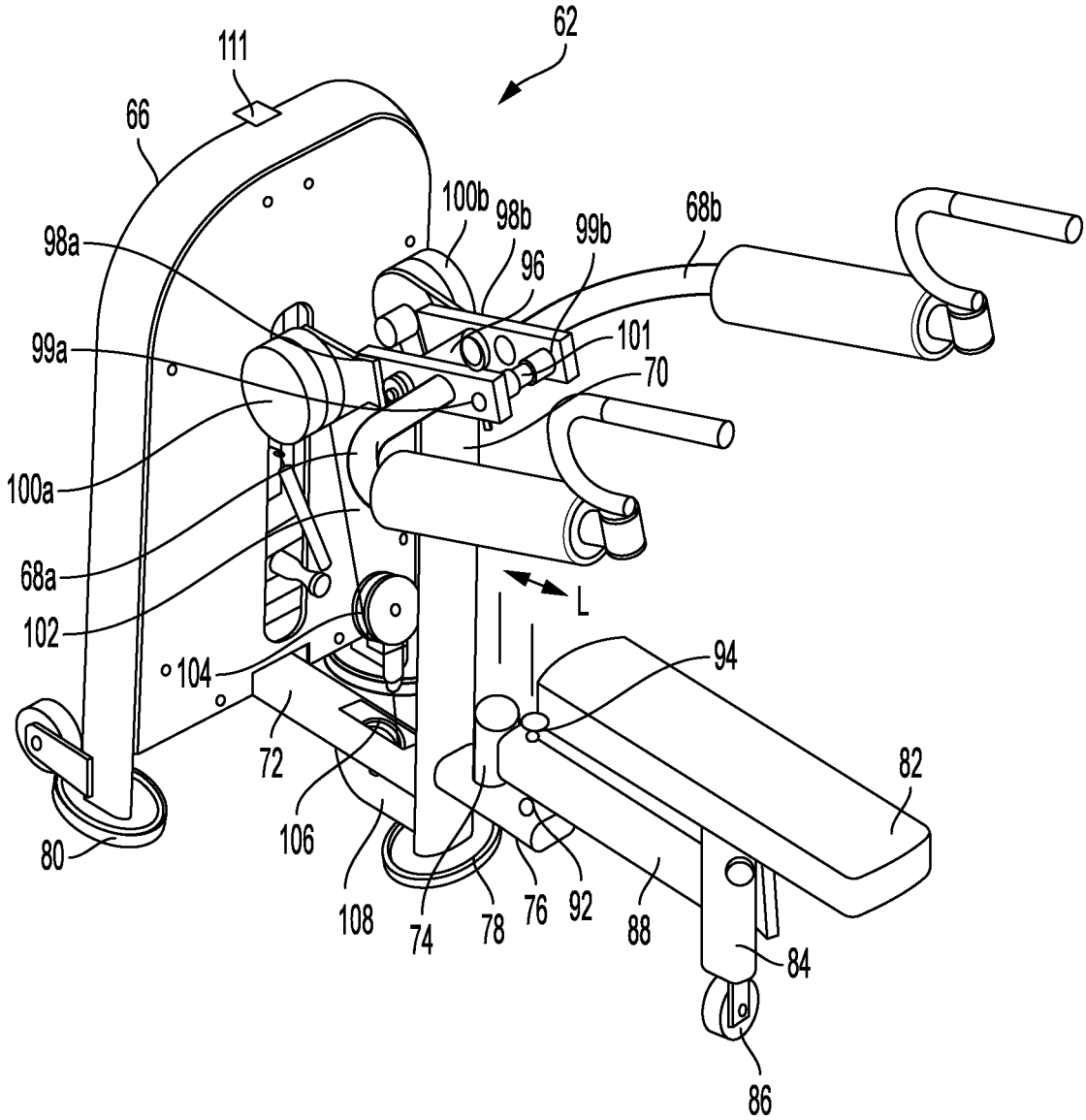
FIG. 2 is a configuration diagram of a shoulder wing device according to a first embodiment of the present invention.

A first embodiment according to the present invention is a shoulder wing device 62 according to the present invention. The outline is shown in FIG. 2.

In the structure of the shoulder-wing device 62, a weight frame 66 incorporating a weight and an arm support frame 70 mounting an arm 68*a* and a 68*b* are connected by a main body base 72.

In the arm support frame 70, a horizontal rotation shaft base 76 on which the seat frame horizontal rotation shaft 74 is mounted is provided to protrude in the horizontal direction on the side opposite to the main body base 72.

Each of the weight frame 66 and the arm support frame 70 is supported by a wide bottom plate 7880 provided at its bottom.

A leg part 84 is projected vertically downward on the rear surface of the rectangular sheet 82, and a horizontally movable wheel 86 is provided at the lower end of the leg part 84. A seat frame 88 protrudes horizontally from an intermediate portion of the leg portion 84 and is connected to the seat frame horizontal rotation shaft 74 at an end portion thereof so as to be rotatable in the horizontal direction.

In the seat frame 88, a spring type pin 94 is arranged at a position of a specific interval L from the center of the rotary shaft 74, and in the horizontal rotary shaft base 76, a recess 92 is provided at a position of the specific interval L from the center of the rotary shaft 74. When the distal end of the spring-type pin 94 is engaged with the recess 92, the rotation of the seat frame 88 is fixed. On the other hand, when the spring-loaded pin 94 is pulled out of engagement with the recess 92, the seat frame 88 is free to pivot.

A rotation shaft 96 is provided at the uppermost portion of the arm support frame 70 in a horizontal direction parallel to the upper portion of the weight frame 66.

Connecting plates 98*a* and 98*b* are attached to both ends of the rotating shaft 96 so as to be rotatable about the rotating shaft 96 independently of each other.

An L-shaped arm 98*a*, 98*b* is provided at one end of the connecting plate 68*a*, 68*b* on the side opposite to the weight frame 66. Counterweights 98*a* and 98*b* are provided at the other ends of the connecting plates 100*a* and 100*b*. The connection plates 98*a* and 98*b* are provided with second through holes 99*a* and 99*b*, respectively, and when the fixing pin 101 is inserted into the through holes, the connection plates 98*a* and 98*b* and the arms 68*a* and 68*b* may be synchronized with each other.

Both ends of the counterweights 100*a* and 100*b* are connected to each other on the left and right sides by wires 102, and the wires 102 are pulled by movable pulleys 104 at the center thereof. The movable pulley 104 is pulled by a further wire 106, and the wire 106 is connected to a weight built in the weight frame 66 via a fixed pulley 108 fixed to the main body base 72, a fixed pulley 110 fixed to a lower portion of the weight frame 66, and a fixed pulley 111 fixed to an upper portion of the weight frame 66. With such a configuration, when the left arm 68*a* is pushed down by the left arm of the user, the counterweight 100*a* moves upward, so that the movable sheave 104 can be moved. In addition, when the arm 68*b* on the right side is pushed down by the right arm of the user, the counterweight 100*b* moves upward, so that the movable sheave 104 can be moved. Further, when the user simultaneously pushes down the left and right arms 68*a* and 68*b* with both arms, the counterweight 100*a* and 100*b* on both sides simultaneously move upward, thereby further moving the movable sheave 104. Since the shoulder wing device 62 is operated by using the left and right arms, the operator can appropriately use the left and right arms by sitting on the seat at an appropriate position and can perform better training. That is, the wire 102 is connected to the counterweight 100*a* and is connected to the counterweight 100*b* via the wheel side of the movable sheave 104. For this reason, when the arm 68*a* is pressed downward, the counterweight 100*a* rises and the wire 102 is pulled toward the counterweight 100*a*. On the other hand, when the arm 68*b* is pressed downward, the counterweight 100*b* is raised and the wire 102 is pulled toward the counterweight 100*b*. At this time, the movable pulley 104 is raised by pulling the wire 102. On the other hand, one end of the wire 106 is connected to the movable pulley 104, and is connected to a weight (not shown) built in the weight frame 66 via the fixed pulley 108, the fixed pulley 110, and the fixed pulley 111 fixed to the upper portion of the weight frame 66. When the movable pulley 104 is pulled, the weight is pulled via the wire 106.

Operation of the First Embodiment of Present Invention

When a healthy person uses the shoulder wing device 62, the spring type pin 94 is engaged with the recess 92. In this case, the sheet 82 can be disposed at a designed position (FIG. 2) without changing the position of the sheet 82 with respect to the arms 68*a* and 68*b*.

Figure 3:
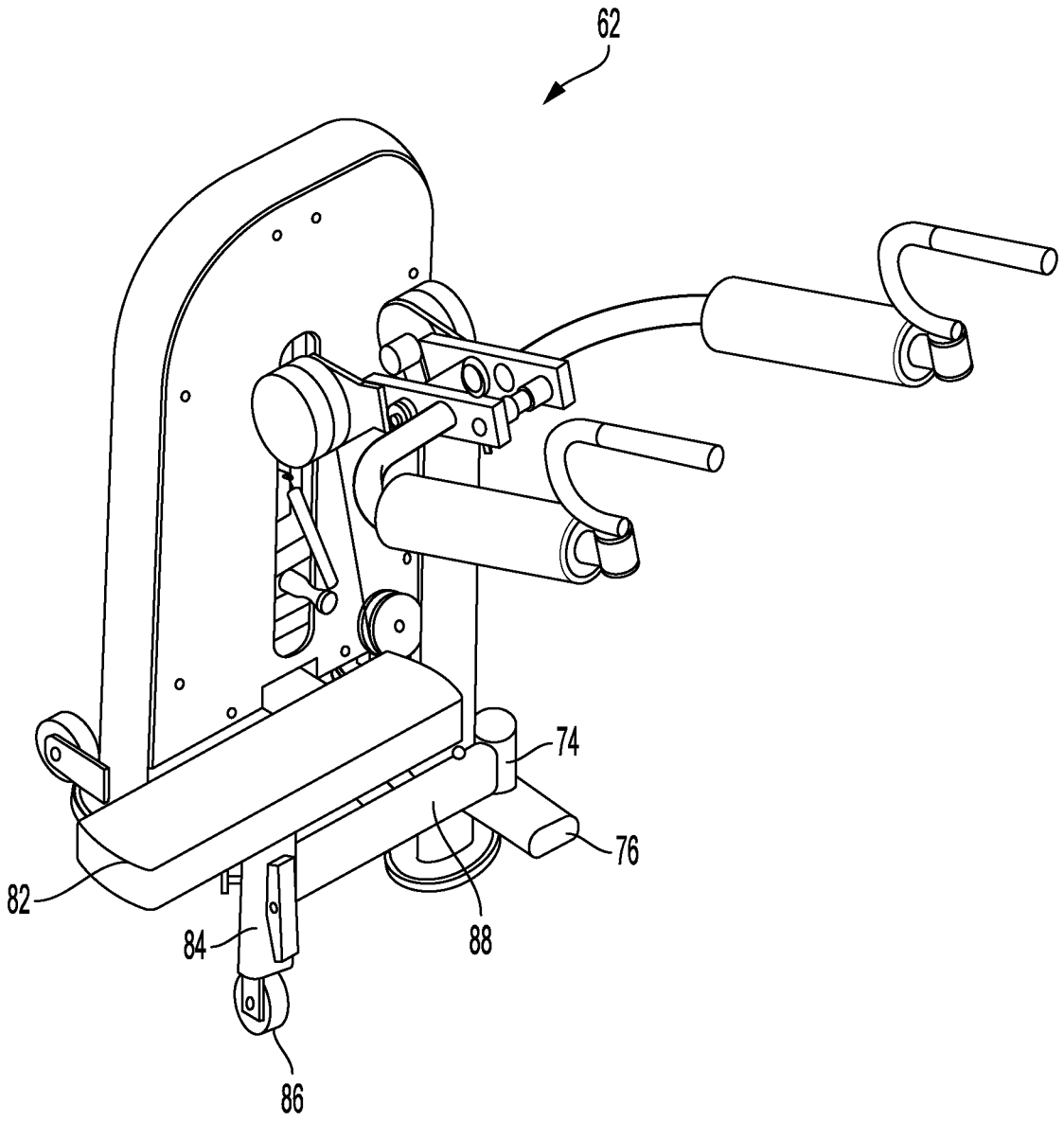
FIG. 3 is a configuration diagram of the shoulder wing device according to the first embodiment of the present invention when the chair is moved.

On the other hand, in the case of use by a wheelchair user, when the spring-loaded pin 94 is released from the engagement in the recess 92, the seat frame 88 is free to rotate and the seat 82 can be moved (FIG. 3). Thus, the wheelchair user can train without getting out of the wheelchair, and the position of the seat 82 can be easily changed.

Example 2

A shoulder wing device 201 according to a second embodiment of the present invention will be described with a focus on differences from the first embodiment. In the arm support frame 70, a vertical rotation shaft base 202 provided with a seat frame vertical rotation shaft 200 is projected in the horizontal direction on the side opposite to the main body base 72.

Each of the weight frame 66 and the arm support frame 70 is supported by a wide bottom plate 7880 provided at its bottom.

On the back surface of the rectangular sheet 82, a leg portion 204 is provided so as to protrude vertically downward, and a leg end portion 206 is provided at the lower end thereof. The seat frame 208 protrudes in the horizontal direction from the middle of the leg portion 204, and is connected to the seat frame vertical rotation shaft 200 at its end portion so as to be rotatable in the vertical direction. Additional means may be provided to secure the seat 82 when it is pivoted vertically.

Operation of Second Embodiment of the Invention

When a healthy person uses the shoulder wing device 201, the seat 82 is used in a horizontal state. In this case, the sheet 82 can be disposed at a designed position without changing the position of the sheet 82 with respect to the arms 68*a* and 68*b*.

Figure 4:
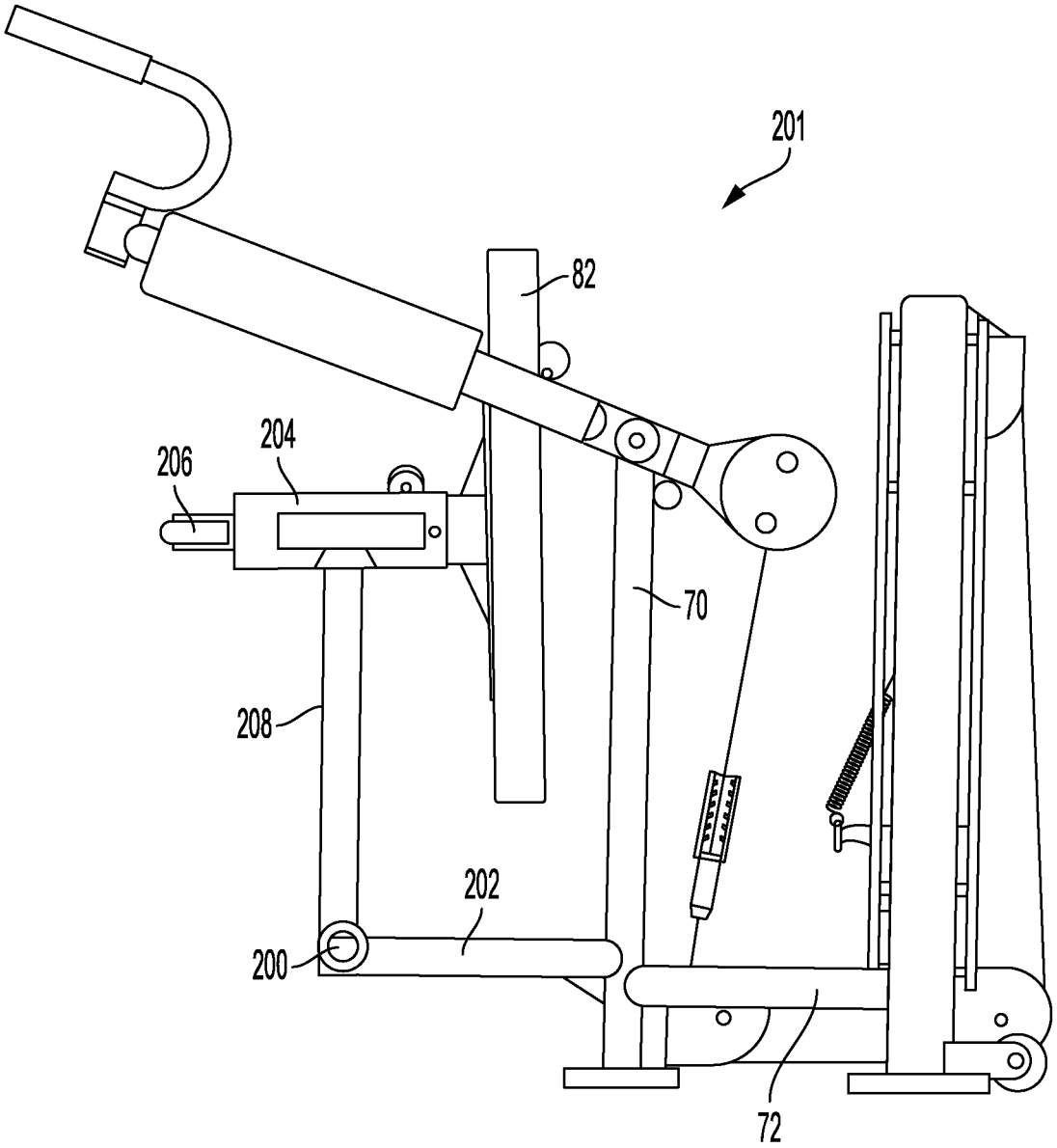
FIG. 4 is a configuration diagram of a shoulder wing device according to a second embodiment of the present invention.

On the other hand, when the wheelchair user uses the seat 82, the seat 82 is lifted up, rotated in the vertical direction around the seat frame vertical rotation shaft 200, and fixed and stopped in the vertical state (FIG. 4). The wheelchair user can train without getting off the wheelchair, and the position of the seat 82 can be easily changed.

Example 3

A shoulder wing device 219 according to a third embodiment of the present invention will be described focusing on differences from the first and second embodiments. In the arm support frame 70, a sheet support base 220 is provided to protrude in the horizontal direction on the side opposite to the main body base 72. An end portion of the seat support base 220 is connected to a seat support frame 222 via a rotation shaft 231, and the front seat 226 is mounted on a side surface of the seat support frame 222. The front seat support frame 222 is connected to the rear seat support frame 227 via a flat hinge 232. The rear seat 228 is mounted on a side surface of the rear seat support frame 227. The front sheet 226 and the rear sheet 228 are combined to form the sheet 224. The rear seat support frame 227 is coupled to the leg frame 230 via the rotation shaft 233. A bottom plate 234 is provided at an end of the leg frame 230.

Operation of Third Embodiment of the Invention

When a healthy person uses the shoulder wing device 219, the seat 224 is used in a horizontal state. That is, the seat support base 220, the rotation shaft 231, the flat hinge 232, and the rear seat support frame 227 are aligned in a straight line, the front seat 226 and the rear seat 228 are mounted thereon, and the leg frame 230 is supported by being bent downward at 90 degrees by the rotation shaft 233. The flat hinge 232 is opened so that the front seat 226 and the rear seat 228 become horizontal at the center, and the two seats are connected and made operable.

In this case, the position of the sheet 224 with respect to the arms 68*a* and 68*b* does not change and can be disposed at a designed position.

Figure 5:
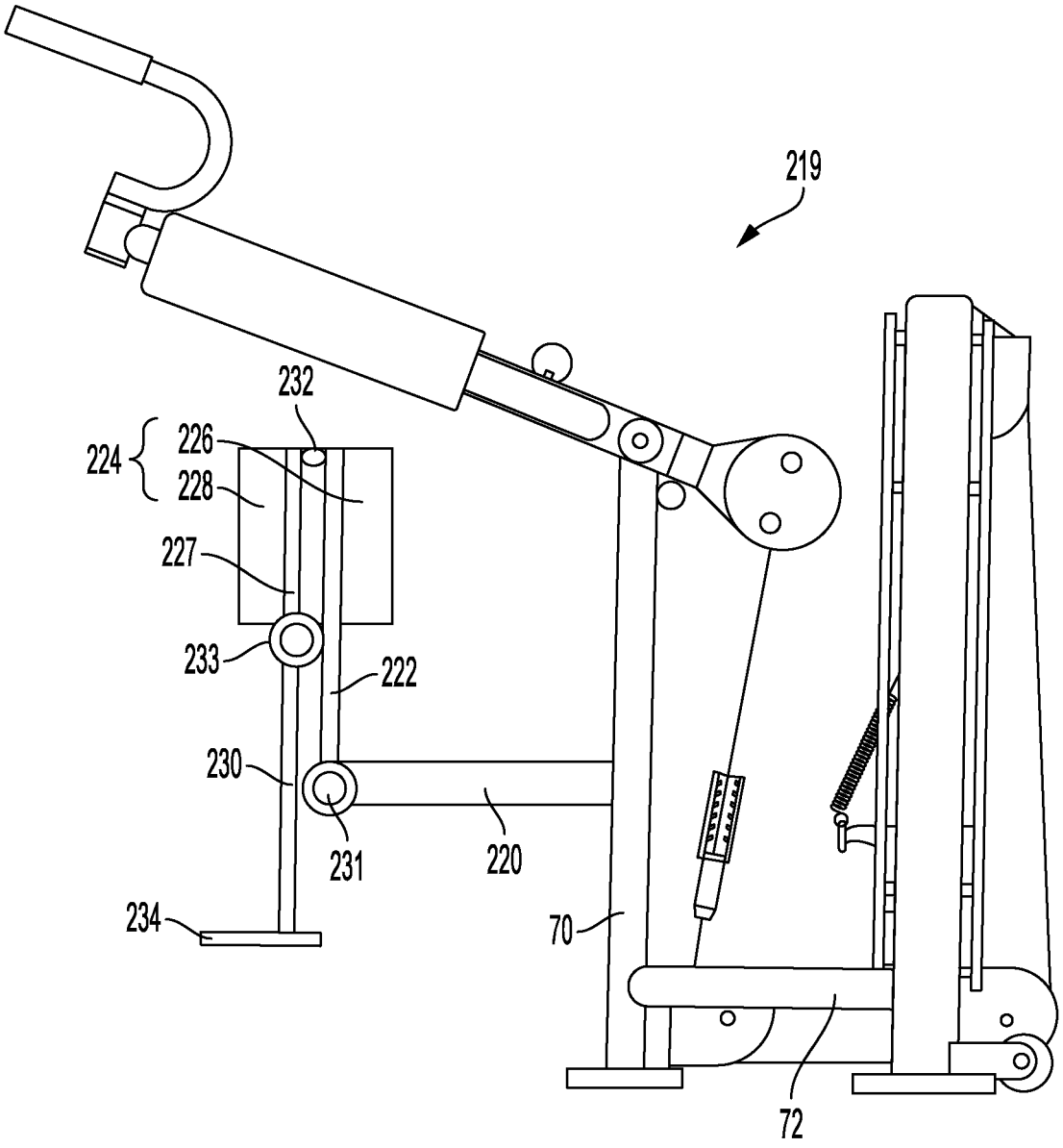
FIG. 5 is a configuration diagram of a shoulder wing device according to a third embodiment of the present invention.
Figure 6:
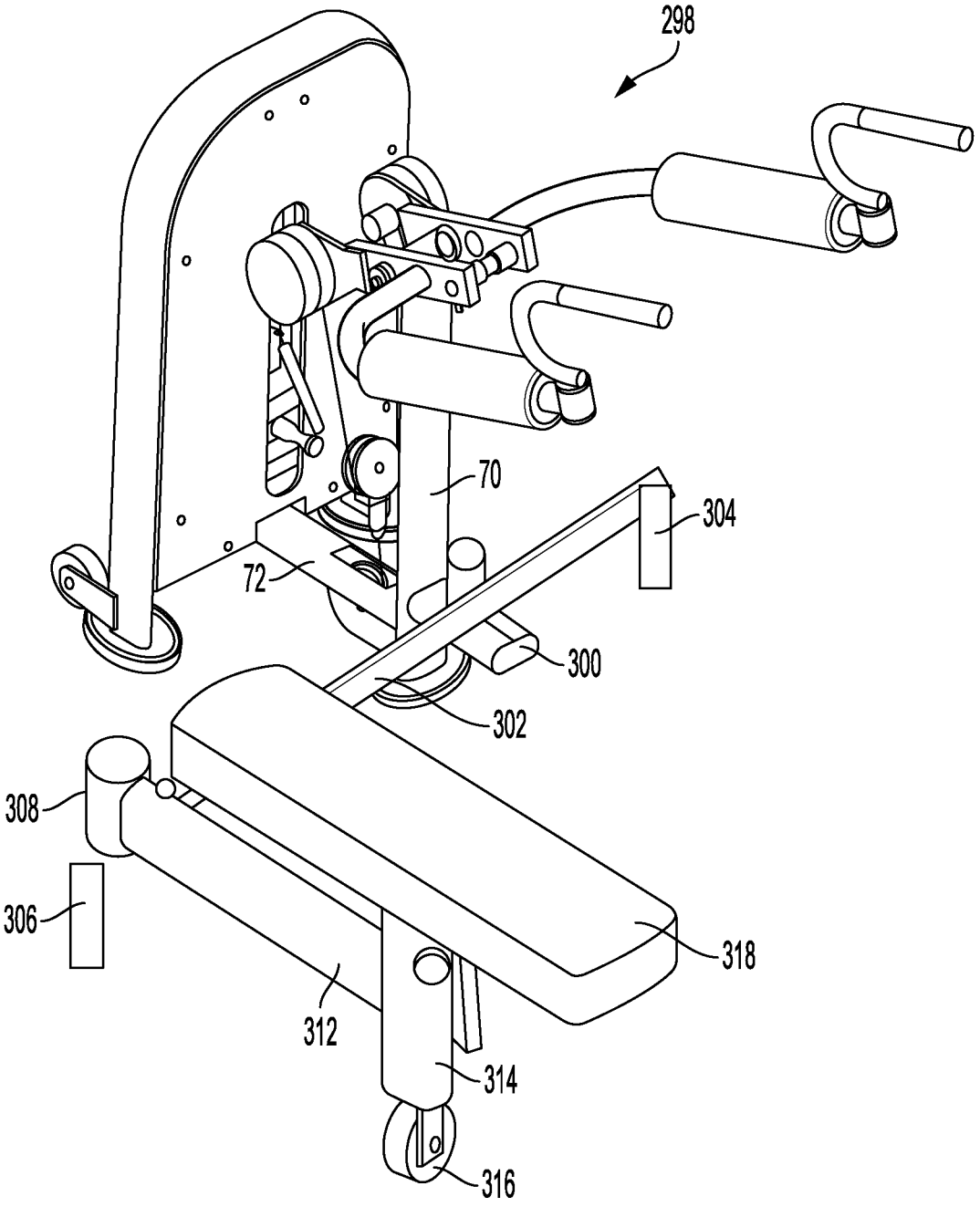
FIG. 6 is a configuration diagram of a shoulder wing device according to a fourth embodiment of the present invention.

On the other hand, when the wheelchair user uses the seat, the seat support base 220 is connected to the front seat support frame 222 by the rotation shaft 231, and the front seat support frame 222 is erected vertically upward by the rotation shaft 231. Further, the front seat support frame 222 is connected to the rear seat support frame 227 via a flat hinge 232, and the rear seat support frame 227 is arranged to face downward. The rear seat support frame 227 is connected to the leg frame 230 via the rotation shaft 233, and the leg frame 230 is also disposed to face downward. Therefore, the depth of the seat 224 is greatly reduced. The wheelchair user can train without getting off the wheelchair, and the position of the seat 224 can be easily changed (FIG. 5). Although the first, second, and third embodiments are manually controlled, they may be controlled by an electric control motor using a stepping motor.

Example 4

A shoulder wing device 298 according to a fourth embodiment of the present invention will be described focusing on differences from the first, second, and third embodiments. In the arm support frame 70, a sheet support base 300 is provided to protrude in the horizontal direction on the side opposite to the main body base 72. A rail 302 is horizontally disposed on the seat support base 300 and supported at both ends thereof by frames 304 and 306. The seat 318 is supported by a seat support frame 314 provided with wheels 316 at its lower end. A sheet support base 312 protrudes from the sheet support frame 314 in a horizontal direction. A guide 308 is provided at an end portion of the sheet support base 312, and a groove portion (not shown) that engages with the rail 302 is provided at a lower end of the guide 308. The sheet 318 is movable in the lateral direction along the rail 302.

Operation of Embodiment 4 of the Present Invention

When the present shoulder wing apparatus 298 is used by a healthy person, the seat 318 can be disposed in the vicinity of the seat support base 300 of the apparatus of the present invention. On the other hand, when the wheelchair user uses the shoulder-wing device 298, the wheelchair user can freely use the shoulder-wing device 298 by sliding the guide 308 on the rail.

What is claimed is:

1. A training apparatus, comprising:

a body having a central longitudinal horizontal axis;

a seat connected to the body via a seat connecting unit and positioned along the central longitudinal horizontal axis in a first position and in a use space;

a seat moving unit configured to move the seat;

a seat fixing unit configured to fix the seat in the first position;

the seat being movable into and out of the use space and into and out of a space of unobstructed relation to the use space via the seat connecting unit, the seat connecting unit comprising:

a horizontal rotator;

wherein the horizontal rotator includes a horizontal rotation shaft base extending along an axis parallel to the central longitudinal horizontal axis, and a seat frame having a horizontal rotation shaft mounted on the horizontal rotation shaft base and being rotatable in a horizontal direction;

wherein the seat frame is connected to the seat via a first portion of a leg; and wherein the seat frame is configured to pivot up to and including 90 degrees to a left of the central longitudinal horizontal axis and up to and including 90 degrees to a right of the central longitudinal horizontal axis, resulting in movement of the seat into the space of unobstructed relation to the use space to the left and to the right of the central longitudinal horizontal axis;

wherein the seat moving unit includes a second portion of the leg, wherein the leg protrudes below the seat and a wheel is provided at a tip end of the second portion of the leg; and wherein the seat fixing unit comprises a spring pin dimensioned and configured to be accepted by a recess formed within the horizontal rotation shaft base to immovably fix a position of the seat frame.

2. The training apparatus according to claim 1, wherein the body comprises a base having a second portion, wherein the second portion of the base further comprises a recess formed therein.

3. The training apparatus according to claim 1, wherein the seat fixing unit is a fixing pin for fixing the horizontal rotation shaft base to the seat frame.

4. The training apparatus according to claim 1, wherein the seat connecting unit is a vertical rotating body connecting the training apparatus body to the seat frame.

* * * * *